United States Patent [19]

Lutz et al.

[11] 4,385,105

[45] May 24, 1983

[54] ELECTROPHOTOGRAPHIC IMAGE CARRIER STRUCTURE

[75] Inventors: Manfred Lutz; Bernd Reimer, both of Warstein, Fed. Rep. of Germany

[73] Assignee: Licentia Patent-Verwaltungs-G.m.b.H., Frankfurt am Main, Fed. Rep. of Germany

[21] Appl. No.: 203,676

[22] Filed: Nov. 3, 1980

[30] Foreign Application Priority Data

Nov. 9, 1979 [DE] Fed. Rep. of Germany ..... 2945309

[51] Int. Cl.[3] ..... G03G 5/14

[52] U.S. Cl. ..... 430/58; 430/67; 430/69; 430/84; 430/85

[58] Field of Search ..... 430/57, 66, 67, 69, 430/84, 85, 58

[56] References Cited

U.S. PATENT DOCUMENTS 4,202,937 5/1980 Fukuda et al. ..... 430/85 X 4,220,696 9/1980 Tonaka et al. ..... 430/57

*Primary Examiner*—John D. Welsh

*Attorney, Agent, or Firm*—Spencer & Kaye

[57] ABSTRACT

An electrophotographic image carrier structure comprises an electrically conductive substrate, a selenium-containing photoconductive layer including more than 35% by weight arsenic, a polyvinyl carbazole covering layer and an intermediate amorphous selenium layer which is situated between the covering layer and the photoconductive layer and which has an arsenic content of zero to less than 0.5% by weight.

9 Claims, 1 Drawing Figure

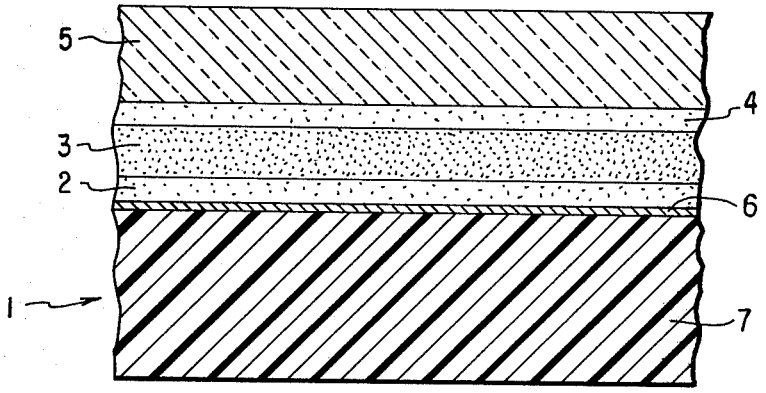
5
4
3
2
6
1
7

ELECTROPHOTOGRAPHIC IMAGE CARRIER STRUCTURE

BACKGROUND OF THE INVENTION

This invention relates to the field of electrophotographic recording and is more particularly concerned with an electrophotographic image carrier structure, including an electrically conductive substrate, a selenium-containing photoconductive layer which generates charge carriers and a charge carrier transporting insulating layer of polyvinyl carbazole.

Electrophotographic processes and apparatus find an ever-widening application in the copier field. These processes and apparatus utilize the property of the photoconductive material, according to which the electric resistance is changed upon illumination by means of an activating irradiation.

Subsequent to electric charging and illumination with an activating irradiation, a latent electric charge image, corresponding to the optical image, can be formed on a photoconductive layer, since at the illuminated areas the conductivity of the photoconductive layer increases to such an extent that the electric charge may be drawn away by the electrically conductive substrate—at least partially, but in any event, to a greater extent than from the non-illuminated areas—while at the non-illuminated (dark) areas the electric charge is substantially preserved. Areas retaining this charge may be made visible by a toner (image powder); the thus-produced toner image can be transferred to a record carrier, such as paper.

Organic as well as inorganic substances and, on occasion, their combination are being used as electrophotographically effective materials. Of the inorganic substances, selenium, selenium alloys and selenium compounds—particularly in an amorphous state—have been widely used. There are further known layer combinations, such as disclosed in German Laid-Open Applications (Offenlegungsschrift) Nos. 2,128,584 and 2,733,052 as well as German Pat. No. 2,444,620, wherein the selenium photoconductor is coated with light-transparent organic covering layers which are preferably polyvinyl carbazole or the like. The covering layers store the charges induced by a corona discharge and serve as charge carrier transport layers for the charge carrier which is formed in the photoconductive layer for producing the charge image on the surface of the image carrier structure.

Layer combinations made of a selenium photoconductor and a polyvinyl carbazole covering layer have a number of advantageous properties. They have a superior flexibility so that, for example, flexible bands may be used as substrates which is a significant advantage as compared to rigid plate-shaped or drum-shaped substrates. Further, the selenium photoconductive layers may be very thin and thus a substantial proportion of the very expensive selenium layers may be replaced by the significantly cheaper polyvinyl carbazole. A further advantageous property is the superior tension strength of even thin polyvinyl carbazole layers. As a result, the layers of the electrophotographic image carrier structure can be charged to high surface potentials and a high contrast potential may be achieved. Further, a polyvinyl carbazole covering layer makes feasible even a negative charging which is of advantage regarding the selection of the toner, particularly since it makes possible the use of the presently very popular single-component toners.

In contrast to all these advantages, however, the known layer combinations have the disadvantage that they have a low sensitivity, since selenium with a high proportion of arsenic, such as the particularly advantageous orthochromatic $As_2Se_3$ compound cannot be used for the photoconductive layer. This is so because layer combinations formed of a system having $As_2Se_3$ and polyvinyl carbazole have such a high residual potential that they cannot find practical application in electrophotography. For this reason, the known layer combinations that include polyvinyl carbazole covering layers have to be limited to the less sensitive selenium or selenium-tellurium photoconductive layers.

SUMMARY OF THE INVENTION

It is an object of the invention to provide an improved electrophotographic image carrier structure which has a selenium-containing photoconductive layer and a polyvinyl carbazole covering layer and which has the advantageous properties of such systems, while, at the same time exhibits the higher spectral sensitivity of a selenium photoconductor having a high proportion of arsenic.

This object and others to become apparent as the specification progresses, are accomplished by the invention, according to which, briefly stated, in an electrophotographic image carrier structure which has an electrically conductive substrate, a selenium-containing photoconductive layer and as insulating charge carrier transport layer of polyvinyl carbazole, the selenium-containing photoconductive layer is selenium with a proportion of more than 35% by weight arsenic and further, between the photoconductive layer and the polyvinyl carbazole covering layer there is provided an intermediate amorphous selenium layer having an arsenic content of zero to less than 0.5% by weight.

The electrophotographic image carrier structured according to the invention has, in addition to a superior flexibility, a high tension strength and the advantage of a thin photoconductive layer, a particularly high spectral sensitivity, but, at the same time the disadvantageous and therefore undesired high residual potential is avoided.

A selenium photoconductive layer of, or containing $As_2Se_3$ is particularly advantageous. To the selenium, in addition to arsenic, tellurium may be added in a proportion up to 30% by weight. The intermediate layer between the photoconductive layer and the covering layer is preferably of pure amorphous selenium and is approximately 0.01 to 0.5 micron thick. The photoconductive layer may also be relatively thin: its thickness can be in the range of approximately 0.1 to 2 micron. This means a significant economy regarding the expensive photoconductive materials.

According to a preferred embodiment of the invention, there is provided an additional intermediate layer which is situated between the electrically conductive substrate and the photoconductive layer. Similarly to the above-noted intermediate layer between the photoconductive layer and the covering layer, the additional intermediate layer too, is of selenium with a proportion of zero to less than 0.5% by weight of arsenic and its thickness is in the range of approximately 0.01 to 0.5 micron. By virtue of the additional intermediate layer, the adhesion between the coarse selenium-arsenic photoconductive layer and the substrate is significantly improved and a charge carrier injection from the substrate to the photoconductive layer is reduced, resulting in a lessened dark decay.

BRIEF DESCRIPTION OF THE DRAWING

The FIGURE is a cross-sectional view of a preferred embodiment of the invention.

DESCRIPTION OF THE PREFERRED EMBODIMENT

Turning now to the FIGURE, there is shown an electrically conductive substrate generally indicated at 1, formed of a flexible polyester foil 7 on which an aluminum layer 6 is laminated or vapor-deposited. While the electrically conductive substrate could be made in its entirety of a rigid aluminum plate or aluminum drum, it is advantageously made of flexible components 6 and 7, because of the good adhesion of the photoconductor on the substrate and the high flexibility of the arrangement.

On the substrate 1 there is situated an intermediate layer 2 of amorphous selenium or a selenium-arsenic alloy with less than 0.5% by weight arsenic, having a layer thickness of between 0.01 and 0.5 micron.

On the intermediate layer 2 there is positioned a photoconductive layer 3 which produces the charge carriers and which has a layer thickness of 0.1 to 2 micron. The photoconductive layer 3 is selenium with a high (in excess of 35% by weight) arsenic content such as $As_2Se_3$ or a corresponding selenium-arsenic-tellurium alloy.

On the photoconductive layer 3 there is provided a further intermediate layer 4 which has the same thickness as the intermediate layer 2 and which too, is of amorphous selenium or a selenium-arsenic alloy having an arsenic content of less than 0.5% by weight. The intermediate layers 2 and 4 as well as the photoconductive layer 3 are applied by conventional methods such as vapor deposition.

On the intermediate layer 4 there is positioned a covering and charge carrier transport layer 5 of polyvinyl carabzole, having a thickness of approximately between 5 to 30 micron. The layer 5 is applied conventionally, for example, by means of a doctor blade and thereafter is dried for a period of ten minutes, after which the entire photoelectric image carrier is ready for use. Instead of polyvinyl carbazole it is feasible to use a radical-sensitized polyvinyl carbazole as the covering layer. For softening purposes, o-terphenyl is added in an appropriate proportion to the polyvinyl carbazole.

With an electrophotographic image carrier structure as described above in conjunction with the FIGURE, the following electrophotographic values were obtained at a copier speed of 10 copies per minute:

| | |
|---|---|
| Surface potential: | 800 volts; |
| Residual potential: | 70 volts; |
| Darkness decay (after 1 minute): | 60 to 70%; and |
| Illumination decay in case of a halogen lamp ($7\ \mu J/cm^2$): | 600 volts. |

It will be understood that the above description of the present invention is susceptible to various modifications, changes and adaptations, and the same are intended to be comprehended within the meaning and range of equivalents of the appended claims.

What is claimed is:

1. In an electrophotographic image carrier structure including an electrically conductive substrate, a selenium-containing photoconductive layer and a polyvinyl carbazole covering layer; said layers being carried by said substrate and said photoconductive layer being situated between said substrate and said covering layer; the improvement wherein said photoconductive layer includes more than 35% by weight arsenic and the improvement further comprising an intermediate layer between said photoconductive layer and said covering layer; said intermediate layer being amorphous selenium having an arsenic content of zero to less than 0.5% by weight.

2. An electrophotographic image carrier structure as defined in claim 1, wherein said photoconductive layer includes $As_2Se_3$.

3. An electrophotographic image carrier structure as defined in claim 1, wherein said photoconductive layer includes tellurium up to 30% by weight.

4. An electrophotographic image carrier structure as defined in claim 1, wherein said photoconductive layer is 0.1 to 2 micron thick.

5. An electrophotographic image carrier structure as defined in claim 1, wherein said intermediate layer is 0.01 to 0.5 micron thick.

6. An electrophotograhic image carrier structure as defined in claim 1, further comprising an additional intermediate layer between said substrate and said photoconductive layer; said additional intermediate layer being selenium having an arsenic content of zero to less than 0.5% by weight.

7. An electrophotographic image carrier structure as defined in claim 6, wherein the selenium of said additional intermediate layer is amorphous selenium.

8. An electrophotographic image carrier structure as defined in claim 6, wherein said additional intermediate layer is 0.01 to 0.5 micron thick.

9. An electrophotographic image carrier structure as defined in claim 1, wherein said substrate comprises a polyester foil carrying an aluminum coating.

* * * * *